US009211560B1

(12) United States Patent
Chen

(10) Patent No.: US 9,211,560 B1
(45) Date of Patent: Dec. 15, 2015

(54) AIR-CONDUCTIVE ROTARY SPRINKLER AND AIR-CONDUCTIVE ROTARY SPRINKLING DEVICE FOR THE SAME

(71) Applicant: Chin-Nan Chen, Keelung (TW)

(72) Inventor: Chin-Nan Chen, Keelung (TW)

( * ) Notice: Subject to any disclaimer, the term of this patent is extended or adjusted under 35 U.S.C. 154(b) by 6 days.

(21) Appl. No.: 14/455,440

(22) Filed: Aug. 8, 2014

(30) Foreign Application Priority Data

Jul. 1, 2014 (TW) ..... 103122638 A

(51) Int. Cl.

| | |
|---|---|
| ***B05B 3/00*** | (2006.01) |
| ***B05B 12/08*** | (2006.01) |
| ***B05B 7/08*** | (2006.01) |
| ***B05B 7/12*** | (2006.01) |

(52) U.S. Cl.
CPC ..... *B05B 12/08* (2013.01); *B05B 7/0815* (2013.01); *B05B 7/1209* (2013.01)

(58) Field of Classification Search
CPC B05B 13/04; B05B 13/0405; B05B 13/0421; B05B 13/0468
USPC ..... 239/225.1, 230, 237, 240, 263
See application file for complete search history.

(56) References Cited

U.S. PATENT DOCUMENTS

| | | | | |
|---|---|---|---|---|
| 7,156,322 | B1 * | 1/2007 | Heitzman | B05B 3/0454 137/625.11 |
| 7,255,291 | B1 * | 8/2007 | Lo | B05B 1/267 239/231 |
| 2004/0164178 | A1 * | 8/2004 | Kah, Jr. | B05B 3/0422 239/237 |
| 2007/0007364 | A1 * | 1/2007 | Gregory | B05B 1/3006 239/206 |

FOREIGN PATENT DOCUMENTS

| | | |
|---|---|---|
| TW | M441519 U1 | 11/2012 |

* cited by examiner

*Primary Examiner* — Davis Hwu
(74) *Attorney, Agent, or Firm* — Muncy, Geissler, Olds & Lowe, P.C.

(57) ABSTRACT

An air-conductive rotary sprinkler includes an air-conductive rotary sprinkling device and an air/fluid supply assembly. The air-conductive rotary sprinkling device further includes a main housing tube, an inner rotary tube and a rotary spray head. The rotary spray head includes a spray-head casing connected with the inner rotary tube and a guide plug installed inside the spray-head casing and further including a helical actuating groove, a helical conductive groove, a central channel and a sideway channel. The fluid in the fluid-conveying pipe can be sprayed along the base axis by the pressured airflow from the central channel, the rotary spray head is rotated by the pressured airflow from the helical air channel, the spray direction of the fluid originally flowing along the base axis is altered by the pressured airflow from the helical conductive channel so as to spray out of the rotary spray head in a rotary manner.

8 Claims, 6 Drawing Sheets

AIR-CONDUCTIVE ROTARY SPRINKLER AND AIR-CONDUCTIVE ROTARY SPRINKLING DEVICE FOR THE SAME

This application claims the benefit of Taiwan Patent Application Serial No. 103122638, filed Jul. 1, 2014, the subject matter of which is incorporated herein by reference.

BACKGROUND OF INVENTION

1. Field of the Invention

The invention relates to an air-conductive rotary sprinkler and an air-conductive rotary sprinkling device for the same, and more particularly to the sprinkler and the sprinkling device for the sprinkler that introduce a helical actuating groove to rotate the rotary spray head and apply a jet flow from a sideway channel to change the spray direction of the fluid flowing along a base axis so as to rotary spray the fluid.

2. Description of the Prior Art

For ordinary cleaning work in the daily life, water is usually sprayed firstly onto a surface of the object to be cleaned, and then a brush or a napkin can be applied to wipe off the dirt on the surface. Such kind of cleaning work exhausts both the labor and the water resource.

In the art, to effectively perform the cleaning work, a flexible pipe is provided to spray the water in a rotary manner. For example, in a Taiwan patent (No. M441519), a rotary fluid-spraying apparatus is to introduce a pressured air from an air channel to a bent pipe conveying a fluid so as to induce a vortex thereinside for rotating the bent flexible pipe itself; such that, as the fluid outflows the bent pipe, a rotary spraying pattern can be achieved.

However, though the bent pipe can formulate a rotary spraying of the water, yet the manufacturing of the bent flexible pipe is comparably difficult and the assembling for the apparatus using the bent flexible pipe is much complicated. Inevitably, the cost for applying the bent flexible would be higher.

SUMMARY OF THE INVENTION

As stated above, currently in the art, though the technology of the bent flexible pipe can contribute successfully to build a rotary spray pattern of the fluid, yet the manufacturing thereabout is much complicated and vulnerable to be distorted by foreign forcing, and also the apparatus using the bent flexible pipe needs tedious assembling steps.

Accordingly, it is the primary object of the present invention to provide an air-conductive rotary sprinkling device as well as an air-conductive rotary sprinkler for applying the same device, in which the air-conductive rotary sprinkling device utilizes an airflow to drive a guide plug and a helical conductive groove and a sideway channel to change the spray direction of a fluid, such that the fluid can be sprayed in a rotary manner.

In the present invention, the air-conductive rotary sprinkling device is connected with an air/fluid supply assembly, in which the air/fluid supply assembly further includes a spray gun and a fluid supply apparatus. The spray gun is to provide a pressured airflow. The fluid supply apparatus further has a fluid-conveying pipe for providing a fluid. The air-conductive rotary sprinkling device includes a main housing tube, an inner rotary tube and a rotary spray head. The main housing tube is connected to the air/fluid supply assembly. The inner rotary tube rotationally about a base axis is mounted inside along the main housing tube. The inner rotary tube further has an air-conveying channel for introducing the pressured airflow and a fluid-conveying pipe penetrating through the air-conveying channel.

The rotary spray head includes a spray-head casing and a guide plug. The spray-head casing is connected with the inner rotary tube and further has an accommodation room communicative in space with the air-conveying channel. The guide plug mounted inside the accommodation room further includes a helical actuating groove, a helical conductive groove, a central channel and a sideway channel. The helical actuating groove pairs an inner wall of the spray-head casing to form an air-conveying channel communicative in space with the helical air channel, such that the pressured airflow out-flowing from the helical air channel can rotate the rotary spray head. The helical conductive groove mounted symmetrically with respect to the helical actuating groove is to pair an inner wall of the spray-head casing so as to form an air-conveying channel in between and communicative in space with the helical conductive channel. The central channel extended along the base axis is also communicative in space with the air-conveying channel. The fluid-conveying pipe penetrates through the central channel. Upon such an arrangement, as the pressured airflow is injected from the central channel, the fluid inside the fluid-conveying pipe would be driven by the pressured airflow to spray out along the base axis. The sideway channel is extended along an air-injection direction, crossing the base axis, and is communicative in space with the helical conductive groove. As the pressured airflow is injected from the sideway channel, the spray direction of the fluid originally along the base axis is altered.

In the present invention, by introducing the pressured airflow to rotate the rotary spray head and to alter the spray direction of the fluid originally flowing along the base axis, the fluid can leave the rotary spray head in a rotary spraying manner.

In one embodiment of the present invention, the air-conductive rotary sprinkling device can further include a bearing having an inner ring sleeved onto the inner rotary tube and an outer ring sleeved into the main housing tube.

In one embodiment of the present invention, the air-conductive rotary sprinkling device can further include an extension tube and a guide pipe, in which the extension tube is connected with the main housing tube and the air/fluid supply assembly, and the guide pipe connected with the extension tube penetrates the inner rotary tube. Also, the guide pipe allows the fluid-conveying pipe to penetrate.

In one embodiment of the present invention, the air-conductive rotary sprinkling device can further include a brush assembly sleeved onto the main housing tube.

In the present invention, the air-conductive rotary sprinkler includes an air-conductive rotary sprinkling device and an air/fluid supply assembly. The air-conductive rotary sprinkling device includes a main housing tube, an inner rotary tube and a rotary spray head. The inner rotary tube rotationally about a base axis is located inside the main housing tube and further has an air-conveying channel. The rotary spray head includes a spray-head casing and a guide plug. The spray-head casing connected to the inner rotary tube further has an accommodation room communicative in space with the air-conveying channel. The guide plug mounted inside the accommodation room further includes a helical actuating groove, a helical conductive groove, a central channel and a sideway channel. The helical actuating groove is to pair with an inner wall of the spray-head casing so as to form in between a helical air channel communicative in space with the air-conveying channel. The helical conductive groove arranged in a symmetric manner with the helical actuating groove is paired with an inner wall of the spray-head casing to form in between a helical conductive channel communicative in space with the air-conveying channel. The central channel extended along the base axis is communicative in space with the air-conveying channel. The sideway channel extended along an air-injection direction crossing the base axis is communicated in space with the helical conductive groove.

The air/fluid supply assembly includes a spray gun and a fluid supply apparatus. The spray gun connected with the main housing tube supplies a pressured airflow into the air-conveying channel. The fluid supply apparatus connected with the spray gun further has a fluid-conveying pipe penetrating both the air-conveying channel and the central channel.

In the present invention, the fluid in the fluid-conveying pipe is blown to spray out along the base axis by the pressured airflow injected from the central channel. The pressured airflow injected from the helical air channel is to rotate the rotary spray head. Further, the pressured airflow is injected from the helical conductive channel to alter the spray direction of the fluid originally flowing along the base axis so as to spray the fluid out of the rotary spray head in a rotary manner.

In one embodiment of the present invention, the air-conductive rotary sprinkling device can further include a bearing having an inner ring sleeved onto the inner rotary tube and an outer ring sleeved into the main housing tube.

In one embodiment of the present invention, the air-conductive rotary sprinkling device can further include an extension tube and a guide pipe, in which the extension tube is connected with the main housing tube and the air/fluid supply assembly, and the guide pipe connected with the extension tube penetrates the inner rotary tube. Also, the guide pipe allows the fluid-conveying pipe to penetrate.

In one embodiment of the present invention, the air-conductive rotary sprinkling device can further include a brush assembly sleeved onto the main housing tube.

All these objects are achieved by the air-conductive rotary sprinkler and the air-conductive rotary sprinkling device for the same sprinkler described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to an air-conductive rotary sprinkler and an air-conductive rotary sprinkling device for the same sprinkler. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
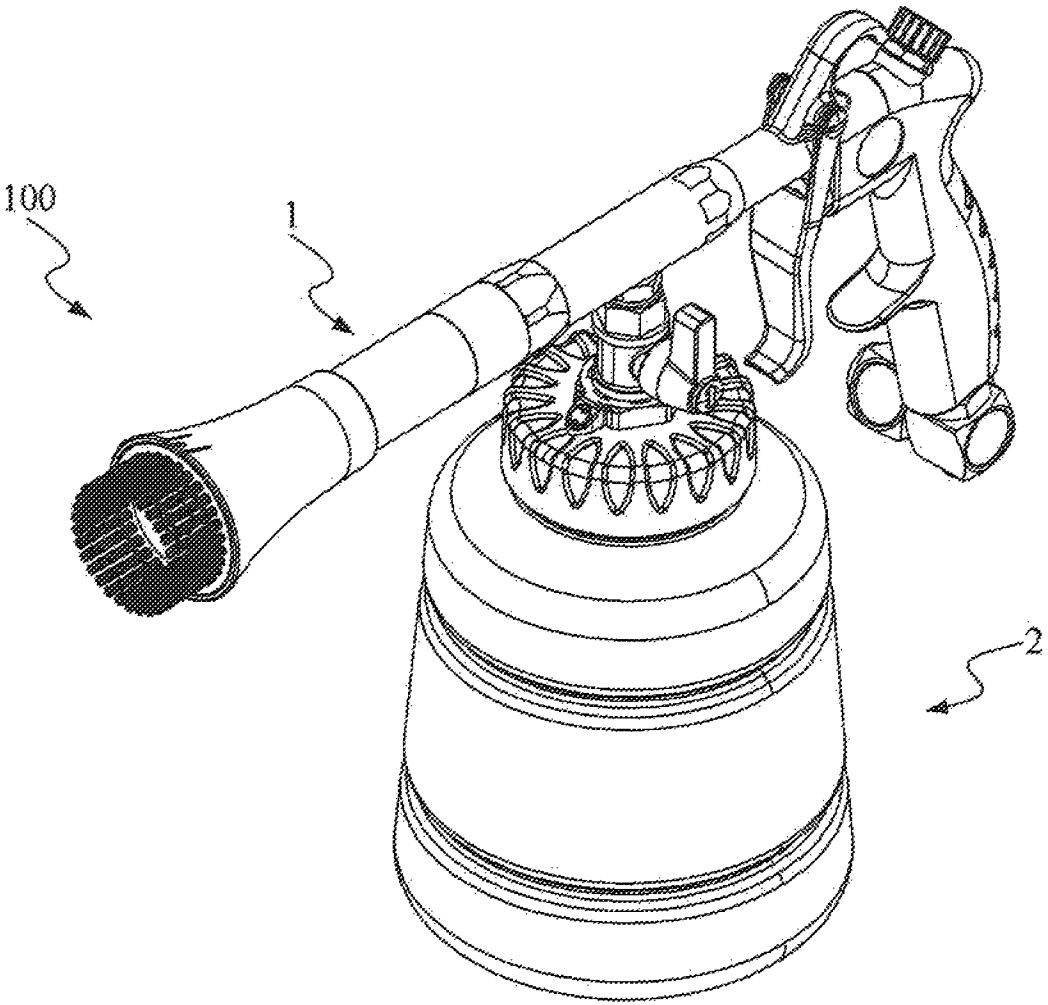
FIG. 1 is a schematic perspective view of the preferred air-conductive rotary sprinkler in accordance with the present invention.
Figure 2:
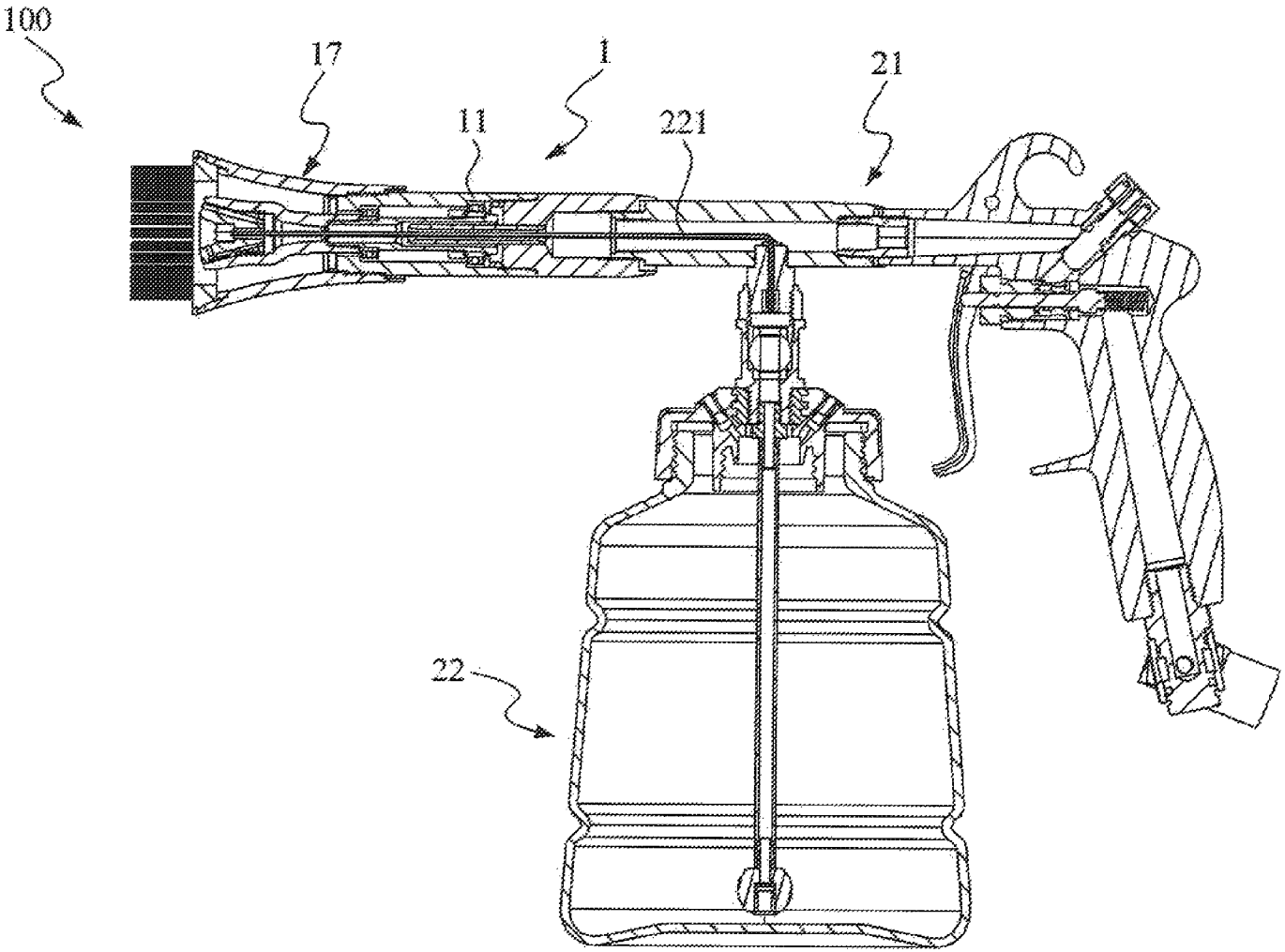
FIG. 2 is a schematic cross-sectional view of FIG. 1.
Figure 3:
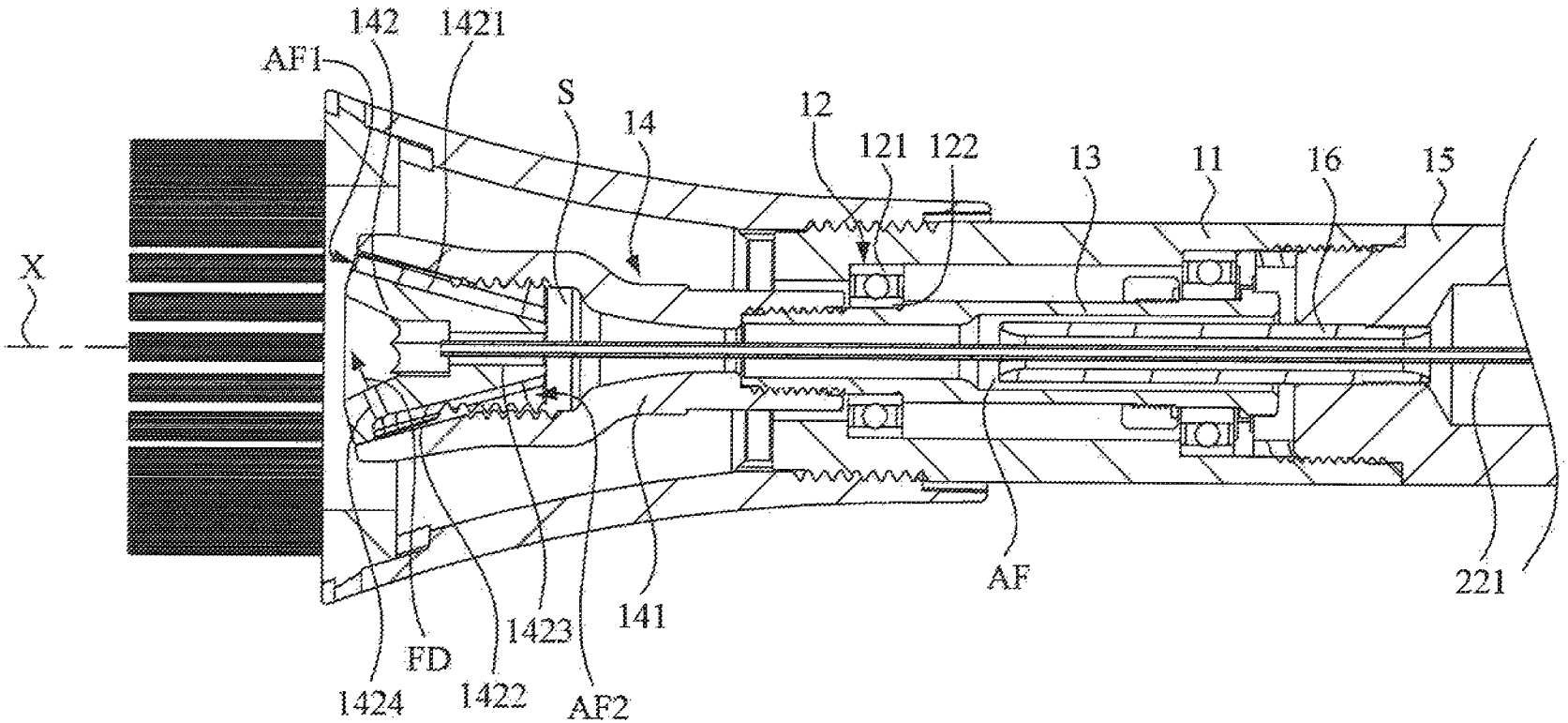
FIG. 3 is an enlarged view upon a portion of FIG. 2.
Figure 4:
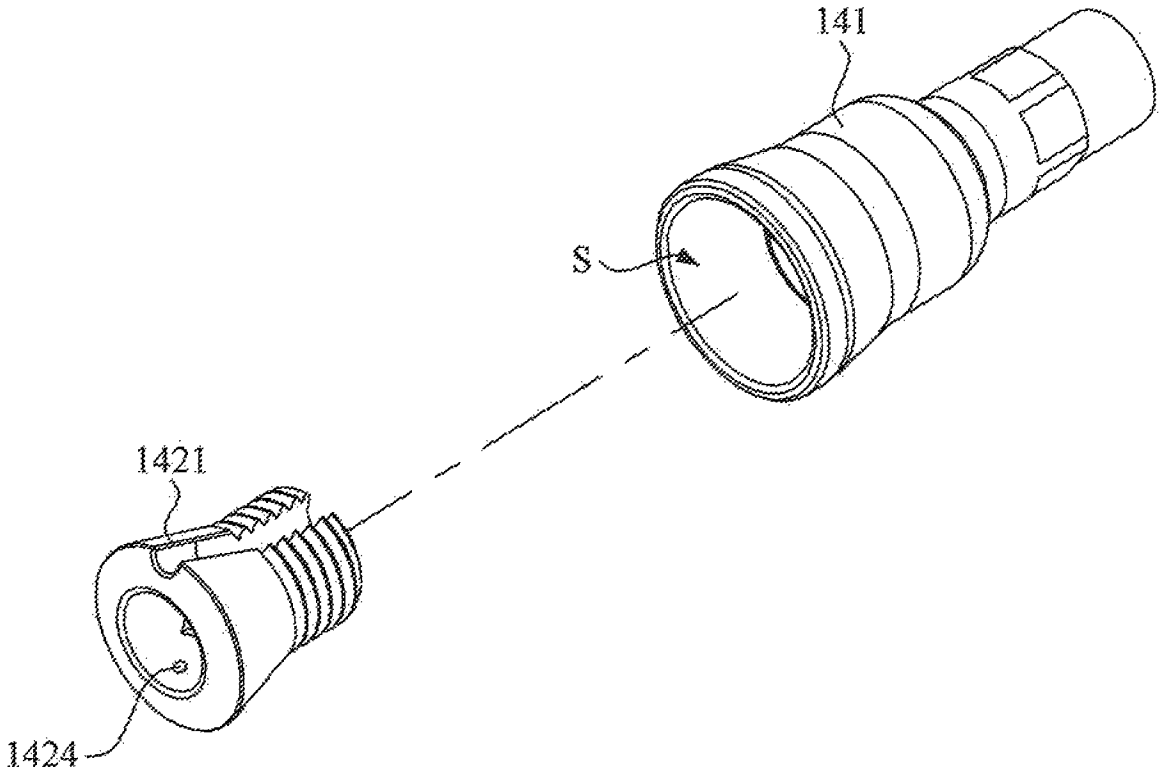
FIG. 4 is a schematic exploded view of a spray-head casing and a guide plug for the air-conductive rotary sprinkler of FIG. 1.

Refer now to FIG. 1 through FIG. 4, in which FIG. 1 is a schematic perspective view of the preferred air-conductive rotary sprinkler in accordance with the present invention, FIG. 2 is a schematic cross-sectional view of FIG. 1, FIG. 3 is an enlarged view upon a portion of FIG. 2, and FIG. 4 is a schematic exploded view of a spray-head casing and a guide plug for the air-conductive rotary sprinkler of FIG. 1.

As shown, the air-conductive rotary sprinkler 100 includes an air-conductive rotary sprinkling device 1 and an air/fluid supply assembly 2.

The air-conductive rotary sprinkling device 1 includes a main housing tube 11, two bearings 12, an inner rotary tube 13, a rotary spray head 14, an extension tube 15, a guide pipe 16 and a brush assembly 17. The bearing 12 includes an inner ring 122 sleeved onto the inner rotary tube 13 and an outer ring 121 sleeved into the main housing tube 11, such that the inner rotary tube 13 can rotate axially inside the main housing tube 11.

By providing the two bearings 12 to support the inner rotary tube 13 at both ends thereof inside the main housing tube 11, so that the inner rotary tube 13 can thus perform shaft rotation about the base axis X inside the fixed main housing tube 11. The inner rotary tube 13 further has an air-conveying channel AF.

The rotary spray head 14 includes a spray-head casing 141 and a guide plug 142. The spray-head casing 141 screwed to engage the inner rotary tube 13 further has an accommodation room S communicative in space with the air-conveying channel AF.

The guide plug 142 screwed to mount inside the accommodation room S further has a helical actuating groove 1421, a helical conductive groove 1422, a central channel 1423 and a sideway channel 1424.

The helical actuating groove 1421 is paired with an inner wall of the spray-head casing 141 so as to form a helical air channel AF1 communicative in space with the air-conveying channel AF. The helical conductive groove 1422 located in a symmetric manner with the helical actuating groove 1421 is paired with an inner wall of the spray-head casing 141 so as to form a helical conductive channel AF2 communicative in space with the air-conveying channel AF.

The central channel 1423 extends along the base axis X and is communicative in space with the air-conveying channel AF. The sideway channel 1424 extends along an air-injection direction FD crossing the base axis X and is communicative in space with the helical conductive groove 1422.

The extension tube 15 engage with the main housing tube 11 and the air/fluid supply assembly 2 by a screwing manner. The guide pipe 16 is screwed to connect the extension tube 15 and penetrates through the inner rotary tube 13. Also, the fluid-conveying pipe 221 penetrates the guide pipe 16.

The brush assembly 17 is sleeved onto the main housing tube 11 so as to provide the user a direct cleaning tool.

The air/fluid supply assembly 2 includes a spray gun 21 and a fluid supply apparatus 22. The spray gun 21 engages the main housing tube 11 so as to send a pressured airflow into the air-conveying channel AF. The fluid supply apparatus 22 is connected with the spray gun 21 and has a fluid-conveying pipe 221 penetrating through both the air-conveying channel AF and the central channel 1423.

Figure 5:
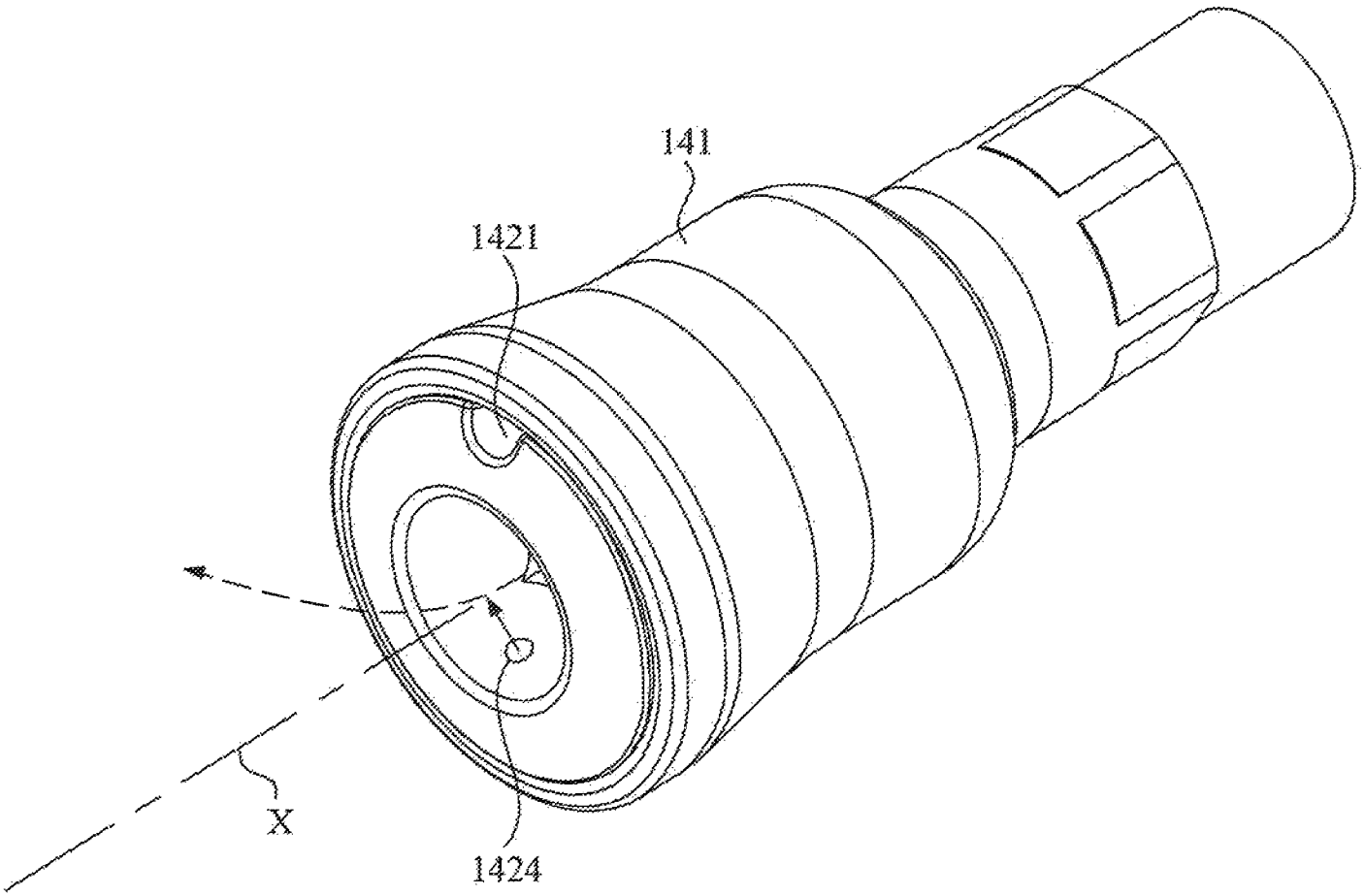
FIG. 5 demonstrates the spray direction change of the fluid at the rotary spray head, affected by a pressured airflow injected from a sideway channel.
Figure 6:
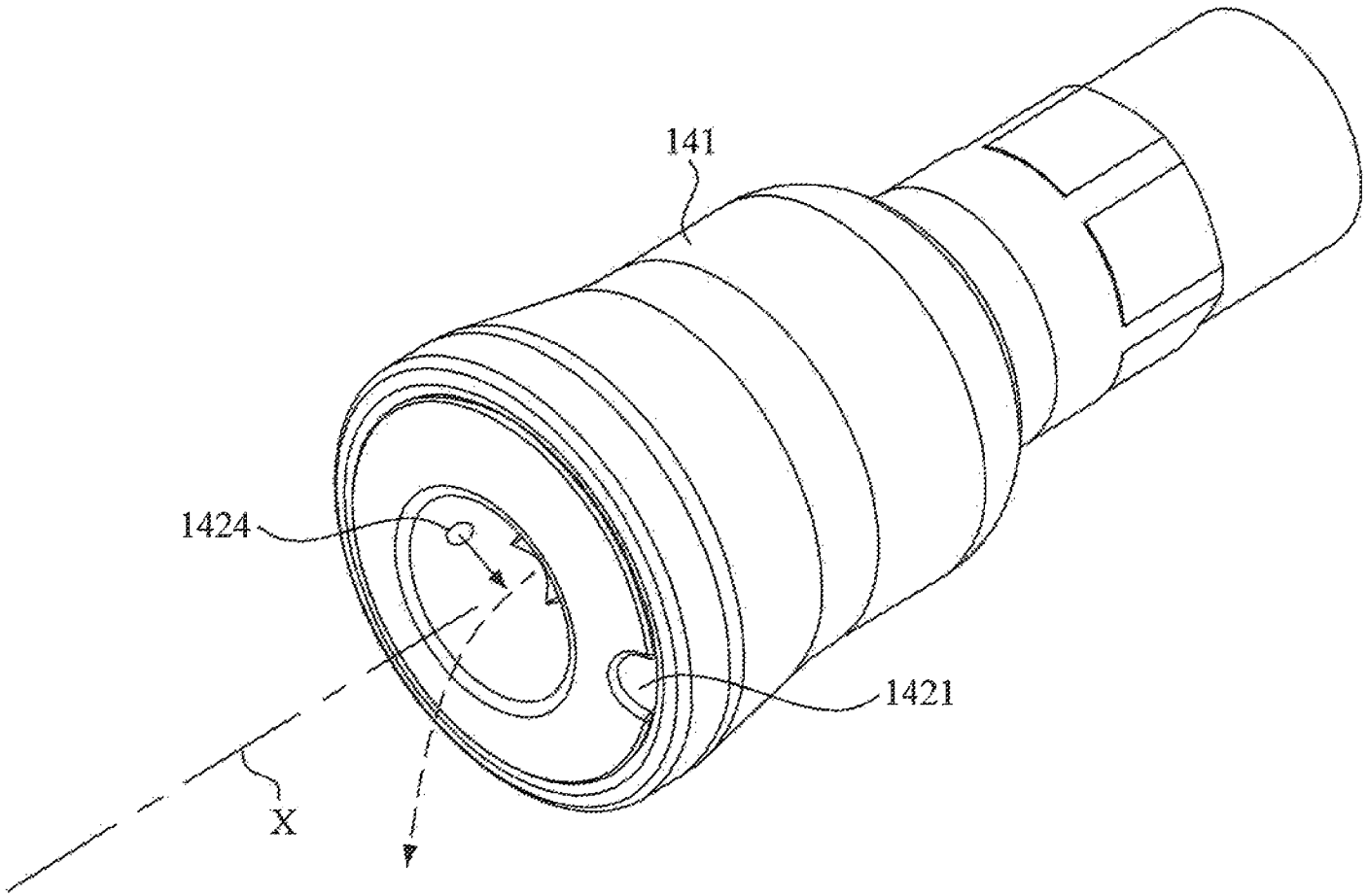
FIG. 6 demonstrates the clockwise rotation of the rotary spray head, driven by the pressured airflow.

Refer now to FIG. 3, FIG. 5 and FIG. 6, in which FIG. 5 demonstrates the spray direction change of the fluid at the rotary spray head affected by a pressured airflow injected from a sideway channel; and FIG. 6 demonstrates the clockwise rotation of the rotary spray head driven by the pressured airflow.

As shown, the fluid in the fluid-conveying pipe 221 would be driven by the pressured airflow from the central channel 1423 to spray out of the pipe along the base axis X. The pressured airflow from the helical air channel AF1 drives the rotary spray head 14 to rotate. The pressured airflow from the helical conductive channel AF2 is introduced to alter the spray direction of the fluid originally flowing along the base axis X so as to spray the fluid out of the rotary spray head 14 in a rotary manner. As shown in FIG. 5 and FIG. 6, while the pressured airflow from the helical air channel AF1 rotates the rotary spray head 14, the spray direction of the fluid is simultaneously affected by the pressured airflow from the helical conductive channel AF2. Further, the rotation of the rotary spray head 14 would be in a rotary spraying pattern.

As stated above in the background section, currently in the art, though the technology of the bent flexible pipe can contribute successfully to build a rotary spraying pattern of the fluid, yet the manufacturing thereabout is much complicated and vulnerable to be distorted by foreign forcing, and also the apparatus using the bent flexible pipe needs tedious assembling steps. On the other hand, the present invention utilizes the helical actuating groove and the helical conductive groove of the guide plug to pair corresponding inner walls of the spray-head casing so as to form the helical actuating channel and the helical conductive channel, respectively. Thereby, the pressured airflows flowing through the helical actuating channel and the helical conductive channel can be injected to drive the rotary spray head. Further, the pressured airflow from the sideway channel communicative in space with the helical conductive groove can be injected by targeting the base axis in an oblique manner, such that the spray direction of the fluid out of the central channel can be altered so as to formulate a rotary spraying. For the present invention does not apply the bent flexible pipe to formulate the rotary spraying, thus the present invention can simplify the manufacturing, reduce the cost, and provide a solid structure to increase the stability and the endurance.

While the present invention has been particularly shown and described with reference to a preferred embodiment, it will be understood by those skilled in the art that various changes in form and detail may be without departing from the spirit and scope of the present invention.

What is claimed is:

1. An air-conductive rotary sprinkling device, connected with an air/fluid supply assembly having a spray gun for providing a pressured airflow and a fluid supply apparatus for providing a fluid through a fluid-conveying pipe, comprising:

a main housing tube, connected with the air/fluid supply assembly;

an inner rotary tube, rotationally mounted inside the main housing tube about a base axis, having an air-conveying channel for introducing the pressured airflow, the fluid-conveying pipe penetrating the air-conveying channel; and a rotary spray head, including:

a spray-head casing, connected with the inner rotary tube, having an accommodation room communicative in space with the air-conveying channel; and a guide plug, installed inside the accommodation room, including:

a helical actuating groove, pairing an inner wall of the spray-head casing to form a helical air channel communicative in space with the air-conveying channel so as to provide the pressured airflow to rotate the rotary spray head;

a helical conductive groove, located symmetrically with respect to the helical actuating groove, pairing another inner wall of the spray-head casing to form a helical conductive channel communicative in space with the air-conveying channel;

a central channel, extending along the base axis and being communicative in space with the air-conveying channel, the fluid-conveying pipe penetrating the central channel so as to have the fluid flowing out thereof to be driven by the pressured airflow injected from the central channel and thus to be sprayed out thereof along the base axis; and a sideway channel, extending along an air-injection direction crossing the base axis and being communicative in space with the helical conductive groove, providing the pressured airflow to alter the spray direction of the fluid originally flowing along the base axis;

wherein, by providing the pressured airflow to rotate the rotary spray head and to alter the spray direction of the fluid flowing originally along the base axis, the fluid is sprayed out of the rotary spray head in a rotary manner.

2. The air-conductive rotary sprinkling device of claim 1, further including a bearing having an inner ring sleeved onto the inner rotary tube and an outer ring sleeved into the main housing tube.

3. The air-conductive rotary sprinkling device of claim 1, further including an extension tube and a guide pipe, in which the extension tube is connected with the main housing tube and the air/fluid supply assembly, the guide pipe connected with the extension tube penetrates the inner rotary tube, and the guide pipe allows the fluid-conveying pipe to penetrate.

4. The air-conductive rotary sprinkling device of claim 1, further including a brush assembly sleeved onto the main housing tube.

5. An air-conductive rotary sprinkler, comprising:

an air-conductive rotary sprinkling device, including:

a main housing tube;

an inner rotary tube, rotationally mounted inside the main housing tube about a base axis, having an air-conveying channel; and a rotary spray head, including:

a spray-head casing, connected with the inner rotary tube, having an accommodation room communicative in space with the air-conveying channel; and a guide plug, installed inside the accommodation room, including:

a helical actuating groove, pairing an inner wall of the spray-head casing to form a helical air channel communicative in space with the air-conveying channel;

a helical conductive groove, located symmetrically with respect to the helical actuating groove, pairing another inner wall of the spray-head casing to form a helical conductive channel communicative in space with the air-conveying channel;

a central channel, extending along the base axis and being communicative in space with the air-conveying channel; and a sideway channel, extending along an air-injection direction crossing the base axis and being communicative in space with the helical conductive groove; and an air/fluid supply assembly, including:

a spray gun, engaging the main housing tube for providing a pressured airflow into the air-conveying channel; and a fluid supply apparatus, connected with the spray gun, having a fluid-conveying pipe penetrating the air-conveying channel and the central channel;

wherein the fluid in the fluid-conveying pipe flowing out is driven to spray out of the fluid-conveying pipe along the base axis by the pressured airflow injected from the central channel, the rotary spray head is driven to rotate by the pressured airflow injected from the helical air channel, the spray direction of the fluid flowing originally along the base axis is altered by the pressured airflow injected from the helical conductive channel, and thus the fluid is sprayed out of the rotary spray head in a rotary manner.

6. The air-conductive rotary sprinkler of claim 5, wherein the air-conductive rotary sprinkling device further includes a bearing having an inner ring sleeved onto the inner rotary tube and an outer ring sleeved into the main housing tube.

7. The air-conductive rotary sprinkler of claim 5, wherein the air-conductive rotary sprinkling device further includes an extension tube and a guide pipe, in which the extension tube is connected with the main housing tube and the air/fluid supply assembly, the guide pipe connected with the extension tube penetrates the inner rotary tube, and the guide pipe allows the fluid-conveying pipe to penetrate.

8. The air-conductive rotary sprinkler of claim 5, wherein the air-conductive rotary sprinkling device further includes a brush assembly sleeved onto the main housing tube.

* * * * *